United States Patent [19]

Makino

[11] Patent Number: 4,520,358

[45] Date of Patent: May 28, 1985

[54] OPTIMIZED DISPLAY DEVICE MEMORY UTILIZATION

[75] Inventor: Tomoaki Makino, Fujisawa, Japan

[73] Assignee: Mitsubishi Denki Kabushiki Kaisha, Tokyo, Japan

[21] Appl. No.: 377,243

[22] Filed: May 11, 1982

[30] Foreign Application Priority Data

May 20, 1981 [JP] Japan ..... 56-76065

[51] Int. Cl.[3] ..... G09G 1/28

[52] U.S. Cl. ..... 340/799; 340/703; 340/747

[58] Field of Search ..... 340/799, 703, 804, 721, 340/747, 750, 745

[56] References Cited

U.S. PATENT DOCUMENTS

| | | | |
|---|---|---|---|
| 3,685,038 | 8/1972 | Flanagan | 340/799 X |
| 3,771,155 | 11/1973 | Hayashi | 340/799 X |
| 3,911,418 | 10/1975 | Takeda | 340/703 |
| 4,016,544 | 4/1977 | Morita et al. | 340/747 |
| 4,180,805 | 12/1979 | Burson | 340/799 X |
| 4,200,869 | 4/1980 | Muzayama et al. | 340/721 |
| 4,206,457 | 6/1980 | Weisbecker | 340/799 X |
| 4,217,577 | 8/1980 | Roe | 340/799 X |
| 4,232,311 | 11/1980 | Agneta | 340/703 |

FOREIGN PATENT DOCUMENTS

| | | |
|---|---|---|
| 2049284 | 4/1971 | Fed. Rep. of Germany . |
| 2324063 | 1/1974 | Fed. Rep. of Germany . |
| 2108801 | 10/1974 | Fed. Rep. of Germany . |
| 2144935 | 2/1975 | Fed. Rep. of Germany . |
| 2540687 | 4/1976 | Fed. Rep. of Germany . |
| 2855731 | 12/1977 | Fed. Rep. of Germany . |
| 2636788 | 2/1978 | Fed. Rep. of Germany . |
| 2438203 | 1/1980 | Fed. Rep. of Germany . |
| 3114923 | 4/1982 | Fed. Rep. of Germany . |
| 55-66022 | 5/1980 | Japan . |

*Primary Examiner*—Marshall M. Curtis
*Assistant Examiner*—Vincent P. Kovalick
*Attorney, Agent, or Firm*—Wenderoth, Lind & Ponack

[57] ABSTRACT

A method of utilizing a memory device for a display device which comprises a parallel combination of an image and a control memory connected to a decoder. At each of addresses assigned to form a color signal, the image memory stores a byte including bits corresponding to green pieces of color information alternating with bits corresponding to red pieces of color information; the control memory stores a byte including four consecutive bits corresponding to blue pieces of color information. The decoder combines associated triads of the red, green and blue bits to form a color signal for a display indicating device. At each of the addresses assigned to form a dot signal, the image memory stores a byte representing the brilliance of a dot and the control memory stores a byte including three consecutive color bits for a foreground to be displayed when a corresponding bit in the image memory is a binary "1" and another three color bits for a background to be displayed when a corresponding bit in the image memory is a binary "0".

2 Claims, 5 Drawing Figures

OPTIMIZED DISPLAY DEVICE MEMORY UTILIZATION

BACKGROUND OF THE INVENTION

This invention relates to an optimized display device memory utilization method.

A conventional display device has comprised an indicating memory device including a parallel combination of a red, a green and a blue memory connected between an address changing circuit and a display indicating device of the raster scan type. The address changing circuit selects address lines within an indication control circuit connected thereto so that the indication control circuit applies successively and simultaneously indicating addresses to all the red, green and blue memories through the address changing circuit and in synchronism with a scanning signal applied to the display indicating device. The red, green and blue memories are successively responsive to the indicating addresses applied thereto to supply successively red, green and blue pieces of color information stored at corresponding addresses thereof to the display indicating device at associated addresses. This has resulted in an indication of a color image on the display indicating device as determined by the red, green and blue pieces of color information stored in the red, green and blue memories at the respective addresses.

When a color image is not displayed on the display indicating device, the address changing circuit selects address lines within a central processing unit connected thereto to cause the latter to read out and write data from and into the red, green and blue memories through the address changing circuit.

In conventional display devices such as described above, it has been necessary to always use the red, green, and blue memories and to also increase the storage capacity of the memories in accordance with the particular dot resolution when an increased dot resolution is desired while decreasing an associated color resolution during the indication of characters. The term "dot resolution" used herein and in the appended claims is defined as the degree to which the brilliance of a dot can be discriminated and the term "color resolution" is similarly defined as the degree to which a color can be discriminated as to its hue, saturation and brilliance. Furthermore, when it is necessary for the display indicating device to display a figure mixed with characters in a single picture, a disadvantage has resulted in that the color information memories which have been prepared for an associated character section are wasted.

Accordingly, it is an object of the present invention to provide a new and improved optimized display device memory device method, wherein the display device is arranged to increase its dot resolution upon displaying characters while increasing its color resolution upon displaying a figure.

SUMMARY OF THE INVENTION

The present invention provides for a display indicating system comprising an indicating memory device including a parallel combination of an image memory and a control memory and a decoder connected to the parallel combination of the image and control memories to convert pieces of information from both the image and control memories to a color signal, the image and control memories having stored therein pieces of information which are different in both their disposition and combination depending upon whether a color figure or characters are to be displayed. The configuration enables a selected color resolution for a color display and a selected brilliance resolution for a monochromatic display and enables the dot resolution to be variable on a single picture.

In a preferred embodiment of the present invention, the image memory may store at each of its first addresses assigned to form the color signal eight bits including odd-numbered bits representing a green piece of color information and even-numbered bits representing a red piece of color information and may store at each of its second addresses assigned to form a dot signal an 8-bit piece of character information representing the brilliance of a dot. The control memory has stored at each of its first addresses eight bits including four consecutive bits representing a blue piece of color information and at each of its second addresses eight bits including three consecutive bits representing three primary pieces of color information for a foreground displayed with any of the corresponding bits in said image memory having a value of binary "ONE" and three consecutive bits following the first-mentioned three consecutive bits and representing three primary pieces of color information for a background displayed with any of the corresponding bits in said image memory having a value of binary "ZERO".

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
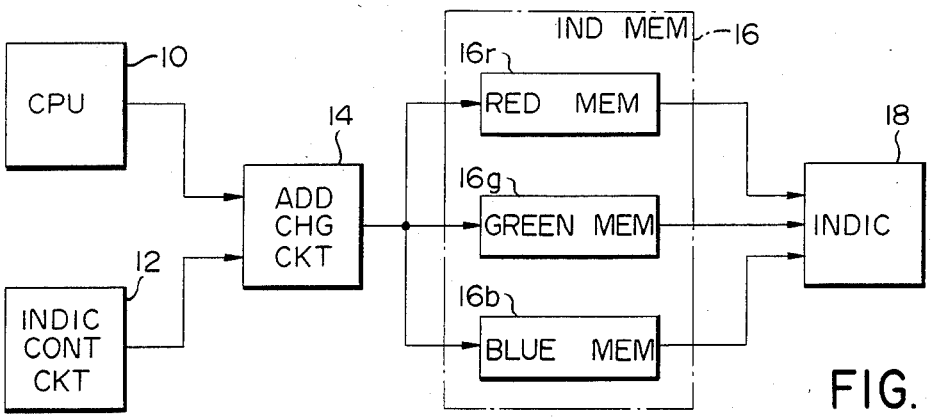
FIG. 1 PRIOR ART
FIG. 1 is a block diagram of a conventional display device.

Referring now to FIG. 1 of the drawings, there is illustrated a conventional display device. The illustrated arrangement comprises a central processing unit 10 and an indication control circuit 12 connected to an address changing circuit 14, and a color indicating memory device 16 connected between the address circuit 14 and an indicating device 18. The indicating memory device 16 includes a red memory 16*r*, a green memory 16*g* and a blue memory 16*b* connected in a parallel circuit relationship to one other in view of the fact that the indicating device 18 in the illustrated example is of the raster scan type (i.e. a conventional CRT display).

The address changing circuit 14 is operative to change address signals from the central processing unit 10 to those from the indication control circuit 12 and vice versa and to apply simultaneously and successively the changed address signals to the red, green and blue memories 16*r*, 16*g* and 16*b*.

More specifically, during the display, the address changing circuit 14 selects address lines within the indication control circuit 12 while the latter circuit 12 delivers simultaneously and successively indicating addresses to the red, green and blue memories 16*r*, 16*g* and 16*b* through the address changing circuit 14 and in synchronism with a synchronizing signal applied to the display indicating device 18. The red, green and blue memories 16*r*, 16*g* and 16*b* then respectively deliver successively and simultaneously red, green and blue pieces of color information stored at addresses corresponding to the applied indicating addresses to the display indicating device 18 which, in turn displays thereon a color as determined by the red, green and blue pieces of color information supplied thereto.

When the display indicating device 18 is not displaying, the address changing circuit can select address lines within the central processing unit 10 to permit the central processing unit 10 to read out and write color data from and into the red, green and blue memories 16*r*, 16*g* and 16*b* respectively through the address changing circuit 14.

The arrangement of FIG. 1 has been disadvantageous in the following respects: First, the arrangement has been required to always include the red, green and blue memories. Second, if it is desired to increase the dot resolution and decrease the color resolution, for example, in the case when characters are displayed, then it has been necessary to increase the storage capacities of the red, green and blue memories in accordance with the particular dot resolution. Finally, with both a character or characters and a figure displayed in a common picture, color information memories for a character section have been useless.

The present invention contemplates the elimination of the disadvantages of the prior art practice as described above by the provision of a display device capable of increasing its dot resolution when displaying a character or characters and also increasing its color resolution when displaying a figure.

Figure 2:
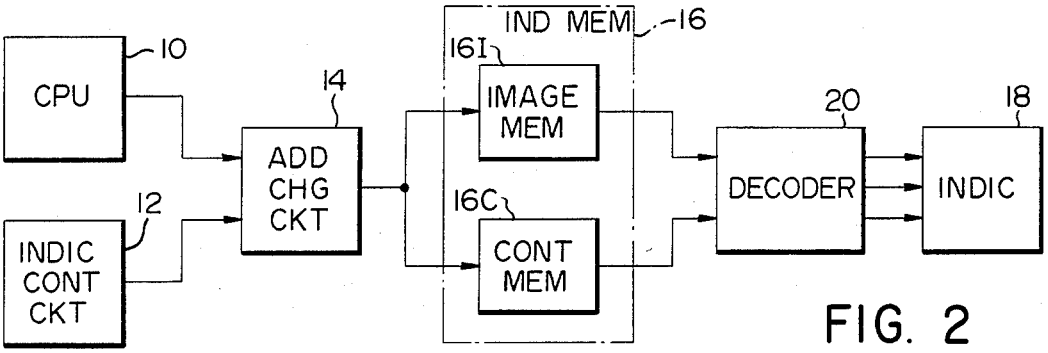
FIG. 2 is a block diagram of one embodiment of a display device using the method of the present invention.

Referring now to FIG. 2 wherein like reference numerals designate the components identical or corresponding to those shown in FIG. 1, there is illustrated one embodiment according to the display device using the method of the present invention. The arrangement illustrated is different from that shown in FIG. 1 only in that in FIG. 2, the indicating memory 16 includes an image memory 16I and a control memory 16C which are, in turn, connected in parallel to each other and in series with a decoder 20 located between the address changing circuit 14 and the display indicating device 18.

It is to be noted that elements 10, 12, 14, and 16 may be fabricated utilizing commercially available off-the-shelf integrated circuits and accordingly, a detailed description thereof has been omitted for simplicity.

For example, the central processing unit 10 may be a model i8085 or i8088 manufactured by the Intel Corporation.

The indicator control circuit 12, when used with a CRT indicator as element 18, may be model CRT5027 from the SMC Corporation, model SND5027 from the Solid State Scientific Corporation or model HD46505 from the Hitachi Corporation.

Address changing circuit 14 may be fabricated utilizing model SN74LS157 which is manufactured by the Texas Instrument Corporation, the Mitsubishi Electric Corporation, the Hitachi Corporation, etc.

The image memory 16 may be fabricated from model M58725, M5K4116 or M5K4164 manufactured by the Mitsubishi Electric Corporation or models HM6167 or HM4864 manufactured by the Hitachi Corporation.

Figure 5:
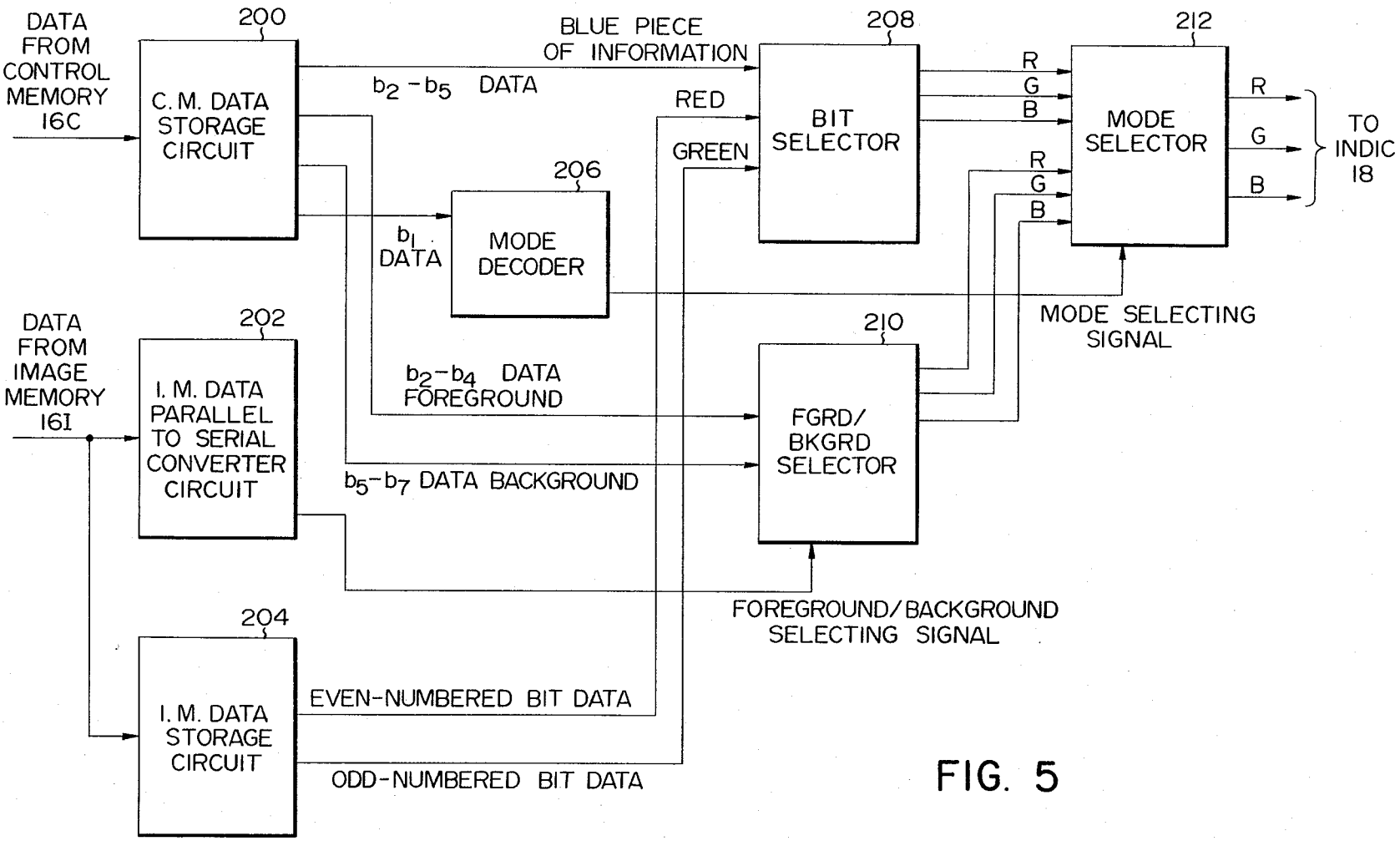
FIG. 5 is a block diagram of the decoder 20.

The decoder 20 may be of a circuit configuration as shown in FIG. 5. The elements shown in FIG. 5 are described below.

Element 200 is a data storage circuit for receiving and storing data from the control memory in each single processing unit, in this case, each byte, and for subsequently outputting said stored data.

Element 202 is a parallel to serial converter circuit for receiving and storing parallel input data from the image memory in a single processing unit and for serially outputting the stored data in serial form.

Element 204 is a data storage circuit for receiving and storing data from the image memory. Circuit 204 operates in the same manner as circuit 200.

Element 206 is a mode decoder for reading the $b_1$ data from the control memory which is stored in circuit 200 and for outputting a mode selecting signal.

Element 208 is a bit selector for receiving the $b_2$ to $b_5$ data from the control memory which is stored in circuit 200 simultaneously with the odd- and even-numbered bit data from the image memory which is stored in circuit 204 and for delivering each triad of red, green and blue signals to the mode selector 212. The bit selector can increase the color resolution and may be also called a "bit timing generator".

Element 210 is a foreground/background selector which is responsive to an output from the parallel to serial converter circuit 202 to deliver a triad of red, green and blue signals for the foreground or background on the basis of the $b_2$ to $b_7$ bit data from the control memory which is stored in circuit 200. The selector 210 can increase the dot resolution and is responsive to bit data from the image memory which has been transformed by the parallel to serial converter 202 into either a logic "0" or "1" state to respectively select the signals for either the background or the foreground.

Element 212 is a mode selector which is responsive to the mode selecting signal from the mode decoder 206 to deliver one of either the triad of R, G and B signals from the bit selector 208 or the triad from the foreground-/background selector 210 to the CRT 18 shown in FIG. 2.

The specific elements of the decoder 20 as illustrated in FIG. 5 and noted above are by no means unique and may be fabricated of various different commercially available elements. That is, the data storage circuit 200 may be fabricated from a plurality of integrated circuit flip-flop chips, a single multiple flip-flop integrated circuit chip, etc. The actual circuit configuration of each of the elements illustrated in FIG. 5 would be clearly apparent to one skilled in the circuit design art and a detailed description thereof has been omitted for simplicity.

The image and control memories 16I and 16C respectively are identical in address to the red, green and blue memories 16*r*, 16*g* and 16*b* respectively and deliver data to the display indicating device 18 in the same manner as described above in conjunction with FIG. 1 excepting that the data is decoded by the decoder 20.

Each of the image and control memories 16I and 16C has stored therein data having a first configuration corresponding to an increased color resolution required for a color figure to be displayed and a second different configuration corresponding to an increased dot resolution required for characters to be displayed. Therefore, there must be a difference in the decoding by the decoder 20, depending upon whether a color image or characters are to be displayed.

Figure 3:
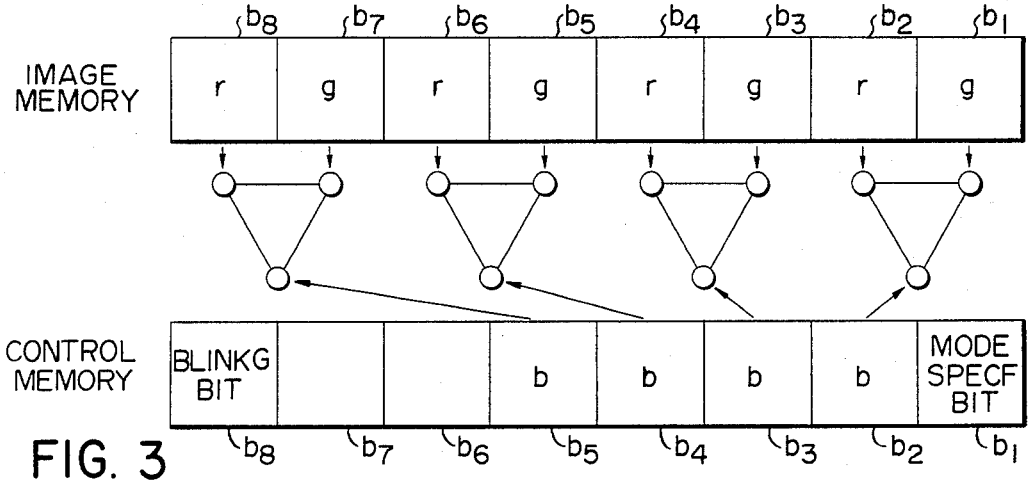
FIG. 3 is a diagram of the bit configurations stored in the image and control memories shown in FIG. 2 at each of the addresses assigned to indicate color information.

FIG. 3 shows, by way of example, the content of data stored at each address of the image memory 16I and also the data stored at each address of the control memory 16C when it is desired to increase the color resolution. In other words, the bit configurations shown in FIG. 3 are stored in the image and control memories 16I and 16C respectively at each of the first addresses assigned to indicate the color information. As shown in the upper row in FIG. 3, the image memory 16I has stored at each of the first addresses a byte consisting of eight bits $b_1, b_2, b_3, \ldots, b_8$ arranged in the named order. The odd-numbered bits $b_1, b_3, \ldots, b_7$ represent a green piece of color information stored at each of those addresses; the even-numbered bits $b_2, b_4, \ldots, b_8$ represent a red piece of color information at the same address as the aforementioned green piece thereof.

On the other hand, the control memory 16C has stored at each of the first addresses a byte consisting of eight bits $b_1, b_2, b_3, \ldots, b_8$ arranged in the named order. The first bit $b_1$ serves as a mode specifying bit and the second, third, fourth and fifth bits $b_2$, $b_3$, $b_4$ and $b_5$ represent a blue piece of color information at the same address as the green and red pieces thereof stored in the image memory 16I. The last or eight bit $b_8$ serves as a blinking bit.

The bit configurations from the image and control memories 16I and 16C as shown in FIG. 3 are simultaneously entered into the decoder 20 where each pair of green and red bits from the image memory 16I are combined with an associated one of the blue bits from the control memory 16C to form a color signal as determined by the red, green and blue pieces of color information. Then, the color signal is delivered to the display indicating device 18 at that address corresponding to the addresses of the image and control memories 16I and 16C from which the now combined pieces of color information have originated. For example, a pair of red and green pieces of color information at the eighth and seventh bits $b_8$ and $b_7$ in the image memory 16I are combined with the blue piece of color information at the fifth bit $b_5$ in the control memory 16C.

The process as described above is repeated with all the first addresses of each of the image and control memories 16I and 16C respectively with the result that the three color pieces of color informations stored in both the image and control memories are successively delivered, as color signals, to the display indicating device 18 through the decoder 20 to indicate a color display on the device.

From the foregoing it will readily be understood that each of the red, green and blue pieces of color information at each of the first addresses in the two memories is formed of four bits resulting in an increase in color resolution.

Figure 4:
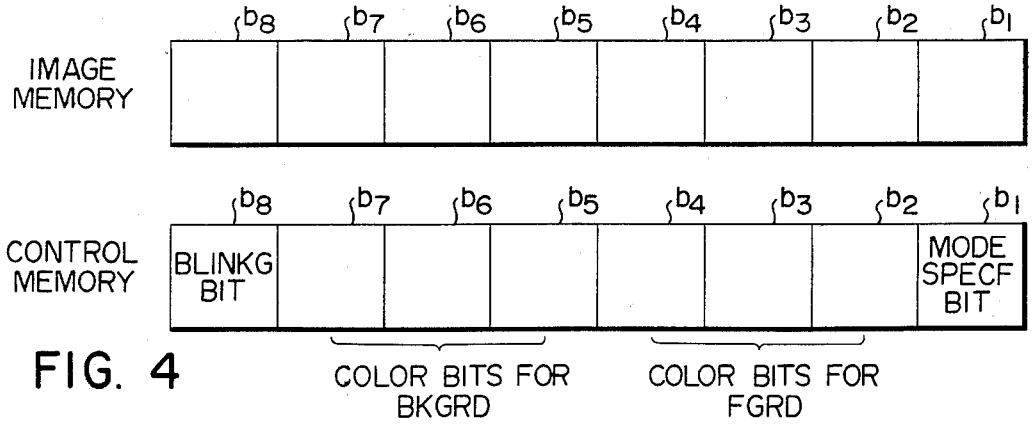
FIG. 4 is a diagram similar to FIG. 4 but illustrating each of the addresses assigned to display character information in the image and control memories shown in FIG. 2.

FIG. 4 shows similarly the contents of data stored at each address in both the image and control memories 16I and 16C on the upper and lower rows respectively when it is desired to increase the dot resolution. In other words, the bit configurations shown in FIG. 4 are stored in the image and control memories 16I and 16C respectively at each of the second addresses assigned to indicate a character or characters. As shown in the upper row in FIG. 4, the image memory 16I has stored at each of the second addresses a byte consisting of eight bits $b_1, b_2, b_3, \ldots, b_8$ arranged in the named order to represent the brilliance of a dot indicated at a corresponding address of the display indicating device 18. Thus, each of those bits may have a value of a binary "1" or "0".

On the other hand, the control memory 16C has stored at each of the second addresses a byte consisting of eight bits $b_1, b_2, b_3, \ldots, b_8$ arranged in the named order. The byte includes a first bit serving also as the mode specifying bit, three bits following the first bit or the second, third and fourth bits representing three primary pieces of color information for a foreground, another three bits following the fourth bit or the fifth, sixth and seventh bits representing three primary pieces of color information for a background and the last or eighth bit serving as the blinking bit.

The bytes from the image and control memories 16I and 16C shown in FIG. 4 are simultaneously delivered to the decoder 20 which, in turn, supplies to an associated address in the display indicating device 18 a dot signal having a brilliance as determined by the byte from the image memory 16I while at the same time supplying to the same address as the dot signal in the device 18 either a color signal for the foreground as determined by the three bits, $b_2$, $b_3$ and $b_4$ when a corresponding bit from the image memory 16I is of a binary "1", or a color signal for the background as determined by the three bits $b_5$, $b_6$ and $b_7$ when a corresponding bit from the image memory 16I is of a binary "0".

The process as described above in repeated with all the second addresses in the two memories 16I and 16C to successively deliver dot signals to the display indicating device 18 while at the same time delivering successively and selectively color signals as determined by the three bits $b_2$, $b_3$ and $b_4$ or the three bits $b_5$, $b_6$ and $b_7$.

From the foregoing it is seen that the display indicating device 18 can indicate a character or characters which have an increased dot resolution because a dot at each address therein has a brilliance or a tone which is determined by eight bits at an associated address in the image memory 16I. Simultaneously, the display indicating device 18 can indicate a foreground and/or a background of the character or characters in a color as determined only by three bits at the associated address in the control memory 16C. Therefore, the foreground and background have a decreased color resolution as compared with the display of color figures alone.

The byte at each address in the control memory 16C includes the first bit serving as the mode specifying bit as described above so that, upon displaying characters mixed with a figure on the display indicating device 18, that bit is effective for changing the decoding by the decoder 20.

The eighth bit included in the byte at each address in the control memory 16C serves as a blinking bit which is effective for blinking an associated dot indicated on the display indicating device 18.

From the foregoing it is seen that in the present invention, the displaying memory device is divided into an image and a control memory and data from the two memories are decoded to express any color or any graduation of tone of a displayed character or characters as the case may be. Therefore, the present invention is advantageous in that the number of displaying memories decreases, resulting in an inexpensive structure having characters which can be displayed with a fine graduation of brilliance thereof and in which a figure can be displayed with a high color resolution.

While the present invention has been illustrated and described in conjunction with a single preferred embodiment thereof, it is to be understood that numerous changes and modifications may be resorted to without departing from the spirit and scope of the present invention. For example, the present invention is equally applicable to monochromatic display devices in which a displayed image is required to have a fine graduation of brilliance thereof. Furthermore, if a blinking bit and a background specifying bit are not required to be included in the control memory, the the control memory may have a reduced storage capacity. Furthermore, in each of the image and control memories, the bits at each address may be arranged in any desired pattern other than that illustrated.

What is claimed is:

1. In a display indicating system having a memory device including a parallel combination of an image memory and a control memory and further including a decoder which is connected to said parallel combination of said image and control memory, a method of utilizing said memory device to selectively store both color images and characters comprising the steps of:

for a pixel of a color image, storing color information in a selected address in said image memory and in selected portions of a selected address in said control memory;

for a pixel of a character, storing dot brilliance information in a selected address in said image memory;

storing a mode specifying bit in a selected portion of a selected address in said control memory, said mode specifying bit being indicative of whether its corresponding pixel is part of a color image or characters;

for a pixel of a character, storing color information in selected portions of a selected address in said control memory;

reading out data stored in a selected address in both said image and control memories and feeding said data to said decoder, said decoder decoding said data into red and green and blue data for feeding a display of said systems in accordance with the state of the mode specifying bit, wherein, for a fixed word size at a selected address in said image and control memories, said display displays a preset degree of color resolution for a color image and a preset degree of brilliance resolution for a character and further enables a variable dot resolution within a single picture displayed by said display.

2. A method as claimed in claim 1, wherein said image memory has stored at each of its first addresses assigned to form a color image pixel, eight bits including odd-numbered bits representing a first color piece of color information and even-numbered bits representing a second color piece of color information and at each of its second addresses assigned to form a dot for a character pixel, an 8-bit piece of character information representing a brilliance of a dot while said control memory has stored at each of its first addresses eight bits including four consecutive bits representing a third color piece of color information and at each of its second addresses eight bits including three consecutive bits representing three primary pieces of color information for a foreground displayed with any of the corresponding bits in said image memory having a value of binary "1" and three consecutive bits following the first-mentioned three consecutive bits and representing three primary pieces of color information for a background displayed with any of the corresponding bits in said image memory having a value of binary "0".

* * * * *